US008312685B2

(12) United States Patent
Gibbs

(10) Patent No.: US 8,312,685 B2
(45) Date of Patent: Nov. 20, 2012

(54) SYSTEM FOR ROOFS AND THE LIKE

(76) Inventor: Alden T. Gibbs, Wilmington, DE (US)

( * ) Notice: Subject to any disclaimer, the term of this patent is extended or adjusted under 35 U.S.C. 154(b) by 631 days.

(21) Appl. No.: 12/432,908

(22) Filed: Apr. 30, 2009

(65) Prior Publication Data

US 2009/0272062 A1 Nov. 5, 2009

Related U.S. Application Data

(60) Provisional application No. 61/050,313, filed on May 5, 2008.

(51) Int. Cl.
*E04D 1/08* (2006.01)

(52) U.S. Cl. ..... 52/547

(58) Field of Classification Search ..... 52/547, 52/546, 543, 550
See application file for complete search history.

(56) References Cited

U.S. PATENT DOCUMENTS

| | | | | | |
|---|---|---|---|---|---|
| 718,165 | A | * | 1/1903 | Sneden | 52/548 |
| 1,173,499 | A | * | 2/1916 | Fleischmann | 52/546 |
| 1,270,905 | A | * | 7/1918 | White | 52/547 |
| 1,544,391 | A | * | 6/1925 | Budd et al. | 52/547 |
| 1,709,376 | A | | 4/1929 | Shirley | |
| 1,722,962 | A | * | 7/1929 | Heppes | 52/547 |
| 1,790,860 | A | * | 2/1931 | Harvey | 52/548 |
| 2,097,715 | A | * | 11/1937 | Bartsch | 52/544 |
| 2,106,948 | A | * | 2/1938 | Harrington | 52/547 |
| 2,307,899 | A | * | 1/1943 | Olsen | 52/357 |
| 2,588,673 | A | * | 3/1952 | Tyson | 52/546 |
| 3,624,975 | A | | 12/1971 | Morgan | |
| 3,640,044 | A | | 2/1972 | Watts | |
| 3,735,543 | A | | 5/1973 | Simon | |
| 4,382,435 | A | | 5/1983 | Brill-Edwards | |
| 4,422,278 | A | * | 12/1983 | Fujihiro et al. | 52/714 |
| 4,476,659 | A | | 10/1984 | Player | |
| 4,548,011 | A | | 10/1985 | Martin | |
| 4,578,922 | A | * | 4/1986 | Wendt | 52/489.2 |
| 4,782,639 | A | | 11/1988 | Ferguson | |
| 4,890,432 | A | | 1/1990 | Shepherd | |
| 5,577,360 | A | | 11/1996 | Gibbs | |
| 5,617,690 | A | * | 4/1997 | Gibbs | 52/518 |
| 5,642,596 | A | | 7/1997 | Waddington | |
| 5,713,158 | A | | 2/1998 | Gibbs | |
| 5,746,029 | A | | 5/1998 | Ullman | |
| 5,758,428 | A | | 6/1998 | Kotlinksi | |
| 5,794,396 | A | | 8/1998 | Gibbs | |
| 5,990,414 | A | | 11/1999 | Posnansky | |

(Continued)

FOREIGN PATENT DOCUMENTS

AU B-60521/94 4/1994

OTHER PUBLICATIONS

PCT Search Report and Written Opinion for PCT/US2009/042220.

*Primary Examiner* — Christine T Cajilig
(74) *Attorney, Agent, or Firm* — Connolly Bove Lodge & Hutz

(57) ABSTRACT

A roof mounting system includes rows of overlapping panels wherein a spacer is provided between the overlapping panels to cause a separation of the outer surface of one panel and the lower surface of the other panel. The spacer is in a wire/band form structure wherein the spacer is bent or bendable to include both horizontal and vertical portions. Other practices are disclosed.

13 Claims, 13 Drawing Sheets

U.S. PATENT DOCUMENTS

| | | | |
|---|---|---|---|
| 6,052,961 | A | 4/2000 | Gibbs |
| 6,453,629 | B1 | 9/2002 | Nakazima et al. |
| 6,463,708 | B1 | 10/2002 | Anderson |
| 6,521,821 | B2 | 2/2003 | Makita et al. |
| 6,570,084 | B2 | 5/2003 | Dinwoodie |
| 6,883,290 | B2 | 4/2005 | Dinwoodie |
| 7,155,870 | B2 | 1/2007 | Almy |
| 7,168,215 | B1 | 1/2007 | Bednarczyk |
| 7,178,295 | B2 | 2/2007 | Dinwoodie |
| 2003/0154666 | A1 | 8/2003 | Dinwoodie |
| 2005/0098697 | A1 | 5/2005 | Collins |
| 2007/0119117 | A1 | 5/2007 | Gibbs |

* cited by examiner

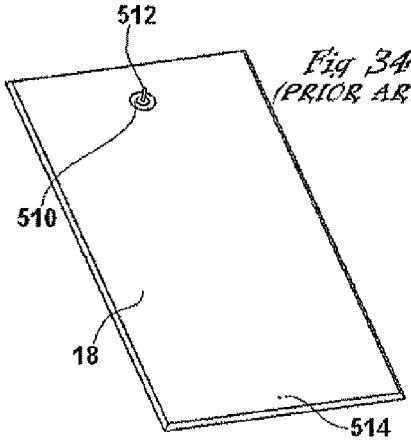
Fig 34
(PRIOR ART)
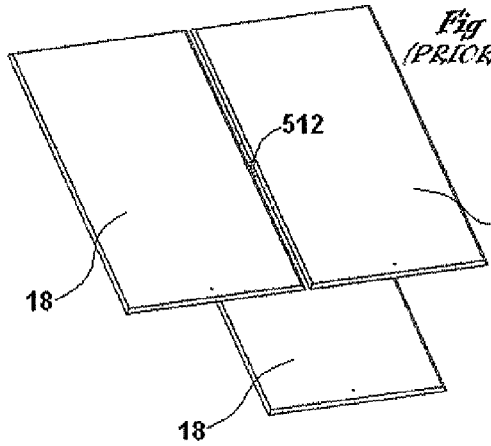
Fig 35
(PRIOR ART)
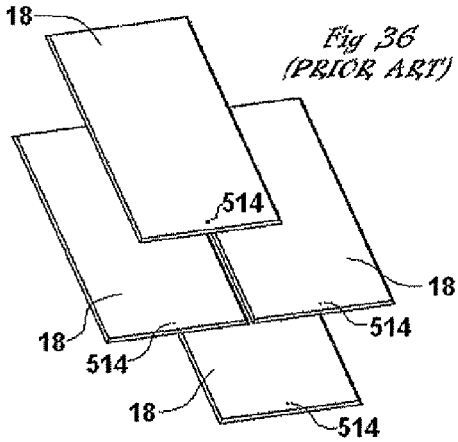
Fig 36
(PRIOR ART)
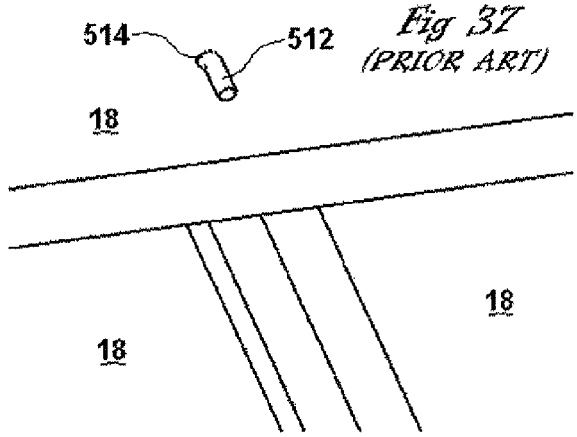
Fig 37
(PRIOR ART)
Fig 38
(PRIOR ART)
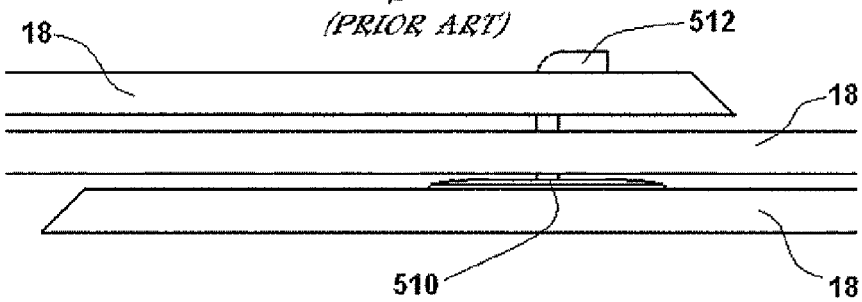

SYSTEM FOR ROOFS AND THE LIKE

CROSS-REFERENCE TO RELATED APPLICATION

This application is based on provisional application Ser. No. 61/050,313, filed May 5, 2008, all of the details of which are incorporated herein by reference thereto.

BACKGROUND OF THE INVENTION

In my U.S. Pat. Nos. 5,577,360, 5,617,690, 5,794,396 and 6,052,961 and in my co-pending application Ser. No. 11/560,409, filed Nov. 16, 2006 and Ser. No. 12/029,017, filed Feb. 11, 2008, I disclosed various roof mounting systems which utilize tracks to mount the roofing panels such as slates to a roof. My co-pending application Ser. No. 11/950,409 and 12/029,017 include in their disclosures techniques for utilizing spacers to create an open area or air layer between vertically adjacent panels or slates. All of the details of these patents and applications are incorporated herein by reference thereto.

SUMMARY OF THE INVENTION

An object of this invention is to provide further techniques for creating an open area or air layers between panels in addition to what is described in the above noted applications.

The present invention, in its broad aspect, uses spacers in wire forms in order to achieve their intended purposes. The wire form is preferably a single wire bent or bendable to include both horizontal and vertical portions. Alternatively, the wire form may be multifilaments in parallel (tow) or in twisted or braided form and may be made from any suitable material, such as metal or plastic. The wire could be of circular or generally circular or oval cross section or could have some flatness such as being in thin band or strip form.

When the spacer is of wire form the wire can be flexible and bendable, Preferably the wire is bendable but of sufficient rigidity to be shape retaining when bent to its desired, intended shape. Alternatively the wire need not be bendable but could be rigid and initially formed in its desired shape.

Various practices of the invention include using a spacer in combination with a fastener, such as a rivet, where the fastener may function to hold down a panel.

THE DRAWINGS

Figure 15:
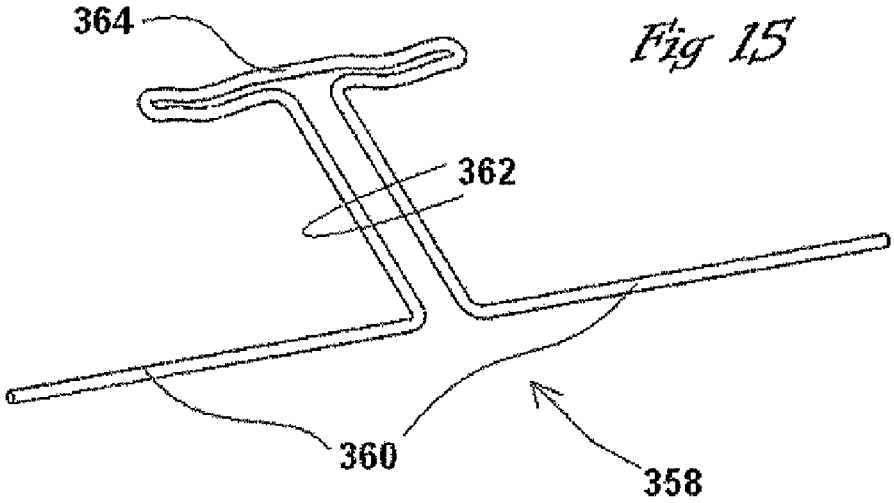
FIG. 15 is a perspective view of yet another spacer in accordance with this invention.
Figure 15B:
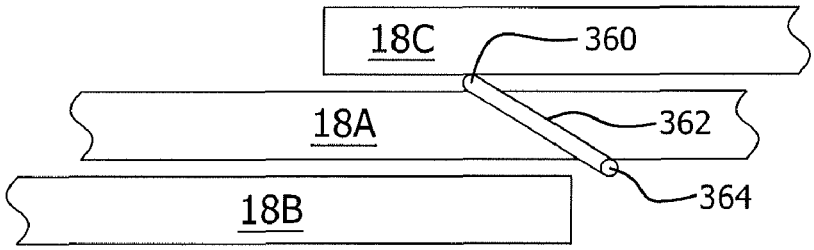
FIG. 15A is a plan view showing a roofing system which incorporates the spacer of FIG. 15 and hooks.
Figure 15C:
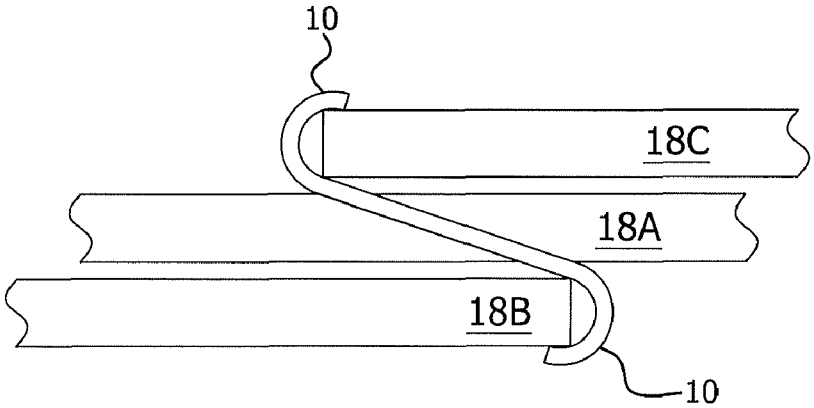
Figure 15D:
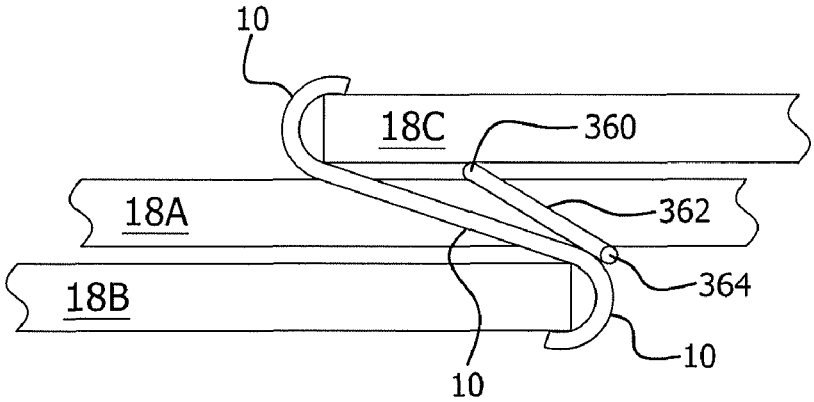

FIGS. 15B-D are side elevational views of different portions of the system shown in FIG. 15A.

Figure 16:
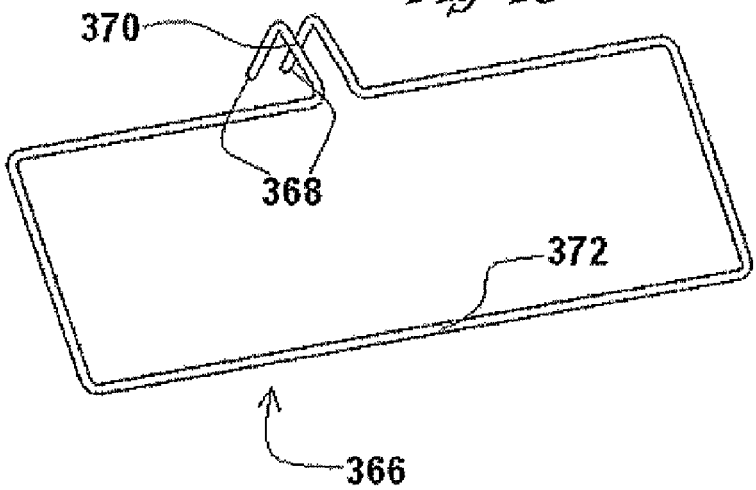
Figure 17:
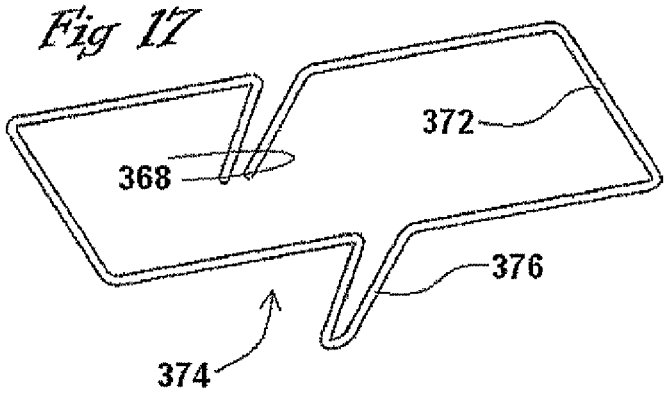
Figure 18:
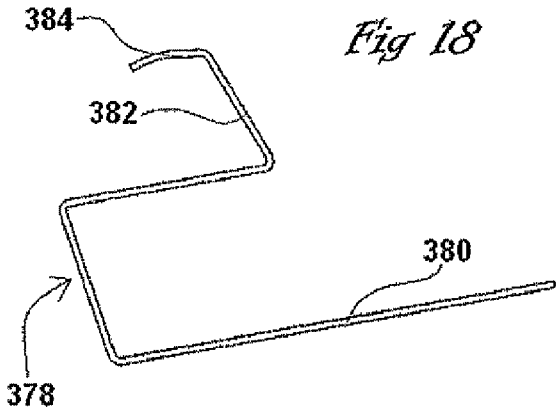
Figure 19:
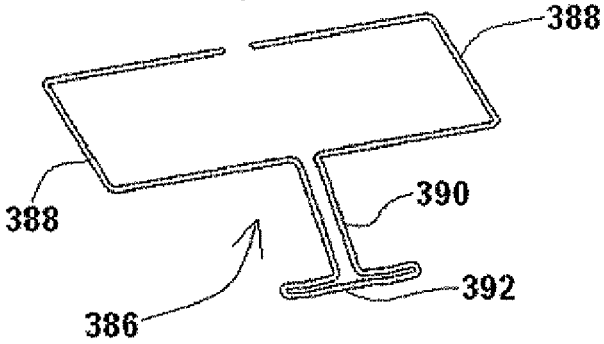
Figure 20:
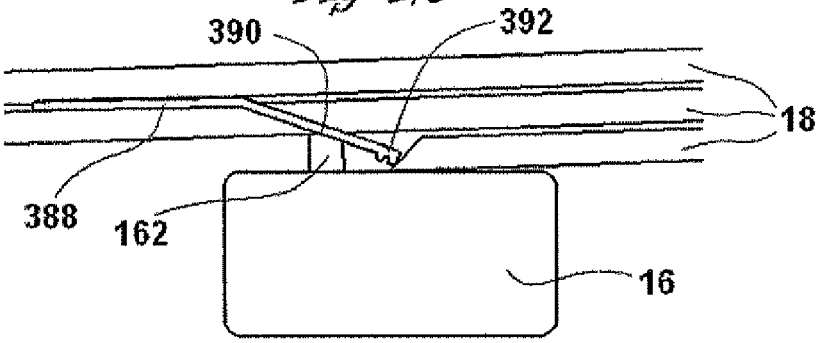
Figure 25:
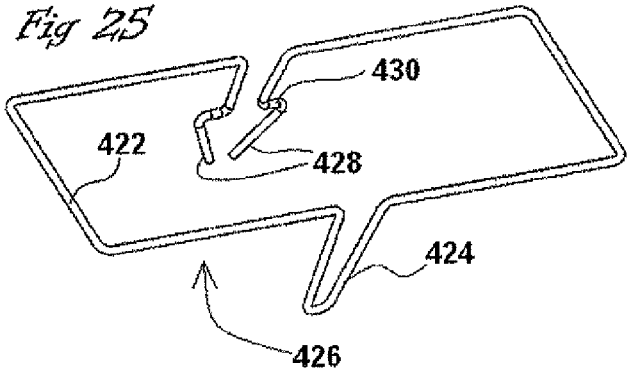
Figure 26:
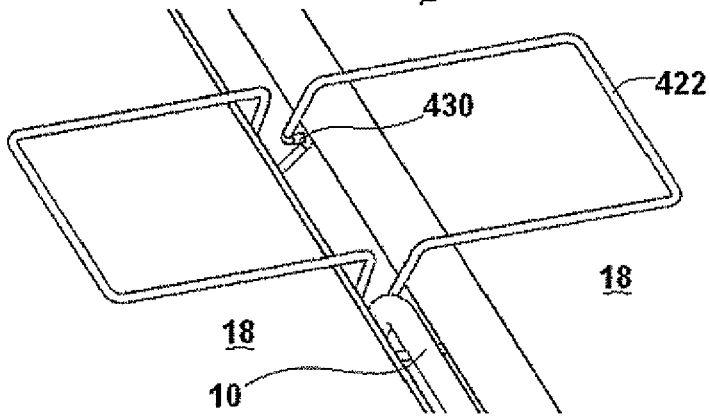
Figure 31:
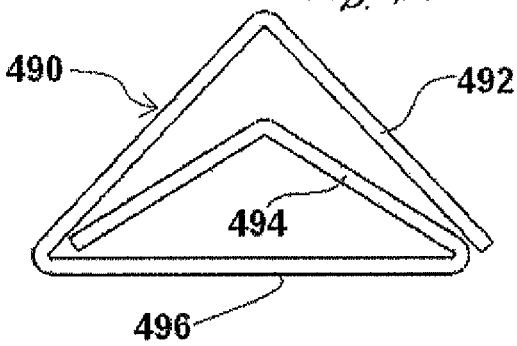
Figure 32:
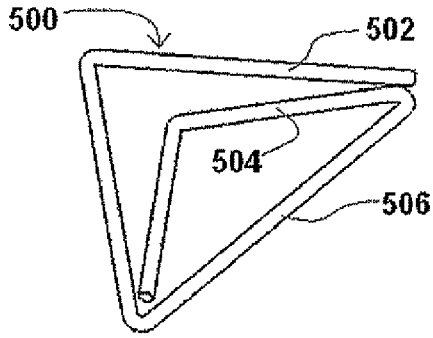
Figure 33:
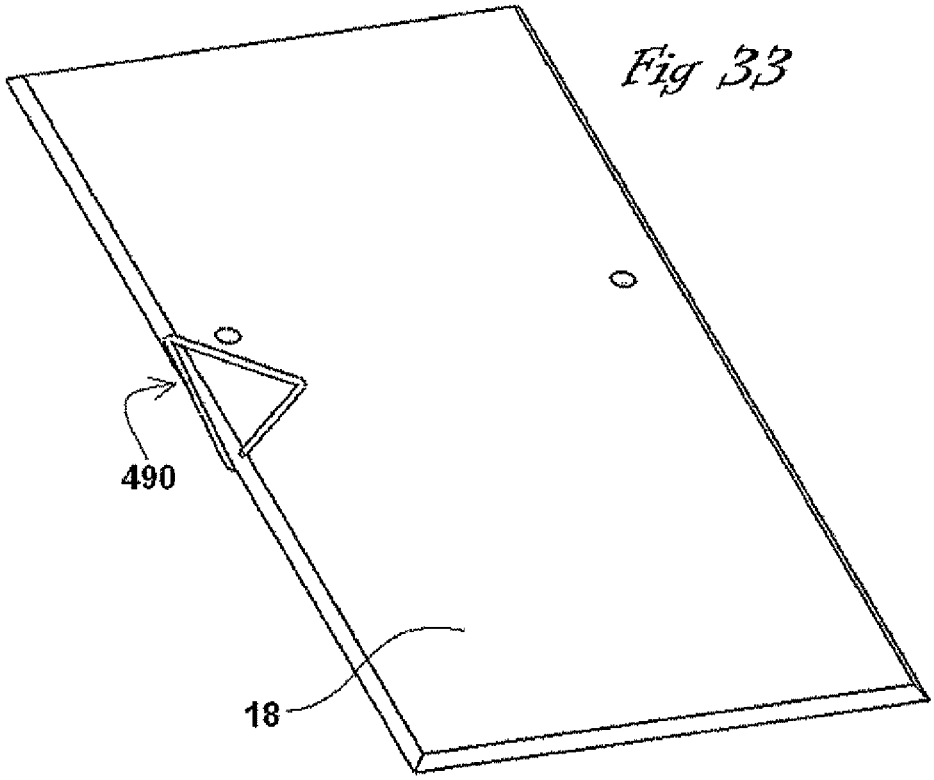

FIGS. 16-18 are perspective views of yet other spacers in accordance with this invention;

FIG. 19 is a perspective view of still yet another spacer in accordance with this invention;

FIG. 20 is a side elevational view of the spacer of FIG. 19 shown mounted in place;

FIGS. 21-24 are perspective views of still yet other spacers in accordance with this invention;

FIG. 25 is a perspective view of yet another spacer in accordance with this invention;

FIG. 26 is a perspective view showing the spacer of FIG. 25 mounted in place;

FIGS. 27-30 are perspective views of still yet other forms of spacers in accordance with this invention;

FIGS. 31-33 are plan views of yet further forms of spacers in accordance with this invention;

FIGS. 34-38 illustrate known practices utilizing rivets for holding down panels; and FIGS. 39-51 show practices of this invention using spacers in combination with rivets.

DETAILED DESCRIPTION

The present invention is based upon variations of the techniques described in my above noted patents and applications, all of the details of which are incorporated herein by reference thereto. As pointed out in, for example, Ser. No. 11/560,409 an advantageous technique which can be incorporated in roofing systems and the like is to provide some form of spacer to create an open area or air layer between vertically adjacent panels or slates which would be particularly effective in dissipating moisture. The present invention is directed to various techniques which incorporate spacing structures.

Spacers have the advantage of slightly separating the panels or slates thereby breaking capillary action, which allows for a greater margin of safety or a reduced headlap. Spacers free trapped water, which reduces aging and prolongs slate life. Spacers also increase roof breathability. Where the spacers are used with hooks, the spacers prevent capillary rise along the hook shank. Where the spacers extend laterally from the hook shank, the spacers interconnect slates and strengthen the attachment.

The present invention generally relates to spacers made of wire form. Alternatively, the wire form may be multifilaments in parallel (tow) or in twisted or braided form and may be made from any suitable material, such as metal or plastic. The wire could be of circular or generally circular or oval cross section or could have some flatness such as being in thin band or strip form. Preferably a wire/band is bent or bendable to include both horizontal and vertical portions. The spacers can be used in various types of installations, such as in the roofing installations disclosed in my prior noted patents and applications. In such installations there might be a plurality of panels such as made from natural or synthetic slate wherein the panels are mounted to a roof structure. The panels could be arranged in a plurality of rows. At least some of the rows overlap in the sense of one row of panels overlapping the adjacent lower row in a staggered fashion. Thus the foot of one panel might overlie the heads of two lower panels. The panels could be mounted in place through the use of underlying tracks wherein the panels are secured to the tracks by the use of fasteners such as spring clips located in slots or kerfs in the side edges of the panels or at any other suitable locations as described in my aforenoted patents and applications. The panels could also be mounted using open hook or open nail installations.

While the invention may be used with any suitable type of roofing panel, the invention is particularly advantageous with slate panels having a non-planar surface. Thin wire/band spacers could readily conform to the irregularities of the non-planar surface.

Figure 1:
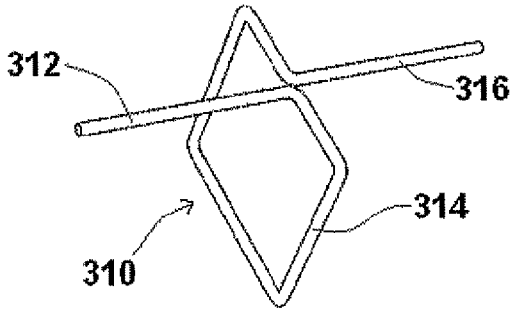
FIG. 1 is a perspective view of a spacer in accordance with this invention.
Figure 2:
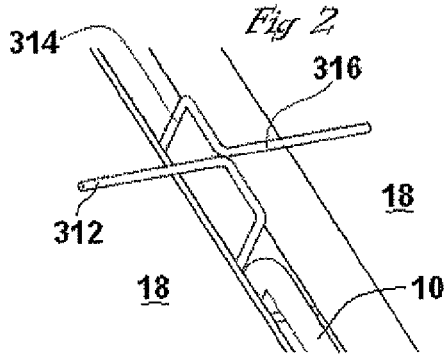
FIG. 2 is a perspective view showing the spacer of FIG. 1 mounted in place.
Figure 3:
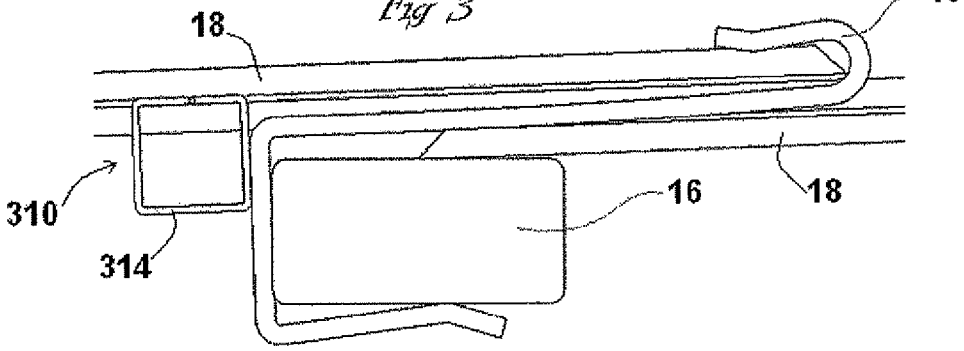
FIG. 3 is a side elevational view of the spacer of FIGS. 1-2 mounted in place.

FIGS. 1-3 show a wire form spacer 310 in accordance with this invention. As shown in FIGS. 1-2 the spacer 310 is formed by bending a wire so that it has one horizontal end 312 which is then bent into a generally closed square or rectangular body 314 and terminates in an oppositely extending horizontal end 316. Each of the horizontal ends 312,316 would be located on a panel 18 (such as a natural slate panel) with the intermediate body 314 disposed between adjacent panels. The horizontal ends 312,316 would function to elevate the overlying panels. Spacer 310 could be used in connection with any other suitable mounting arrangement. FIG. 3, for example, shows spacer 310 used with a hook 10 which is mounted around batten 16.

Spacer 310 thus exemplifies an open, hooked installation where the spacer is inserted between the panels or slates to rest on a batten and/or hook.

Figure 4:
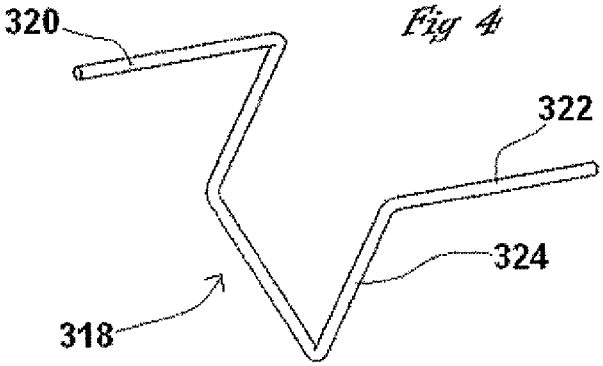
FIG. 4 is a perspective view of yet another form of spacer in accordance with this invention.

FIG. 4 shows a variation of a wire form spacer 318 which is bent to have a pair of oppositely extending horizontal ends 320,322 with an intermediate body portion 324 which is generally open and U-shaped. Spacer 318 is another form of open hook installation where the spacer could rest on a batten and/or hook.

Figure 5:
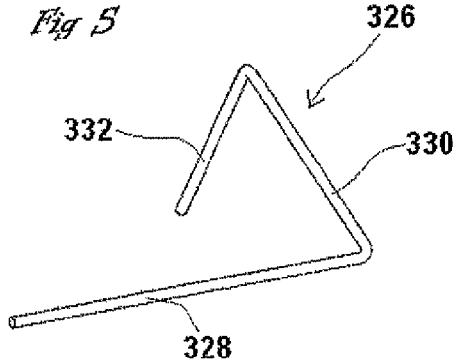
FIG. 5 is a perspective view of still yet another spacer in accordance with this invention.
Figure 6:
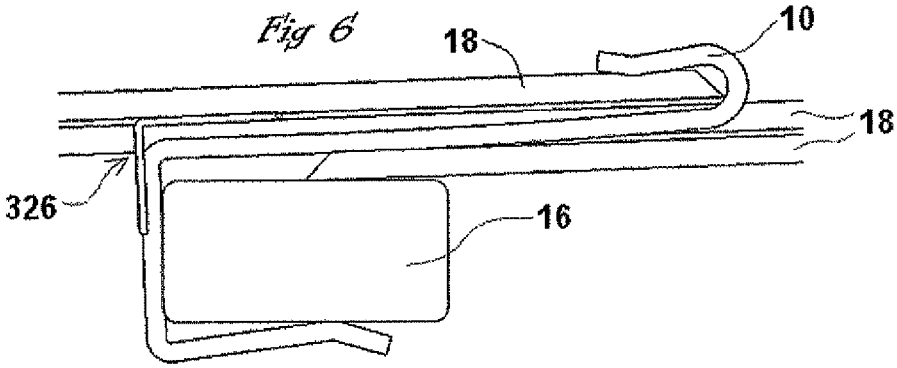
FIG. 6 is a side elevational view showing the spacer of FIG. 5 mounted in place.

FIG. 5 shows yet another wire form spacer 326 which is bent to have a single horizontal end 328 that would rest on a panel which then merges into intermediate portion 330 lying between panels and terminates in downwardly extending end 332. FIG. 6 illustrates a single spacer 332 used in conjunction with a hook 10 for mounting the panels 18 to a batten 16. The open hook installation illustrated could feature a spacer hanging on a batten and/or hook wherein two spacers could be used, one for each panel or slate side.

Figure 7:
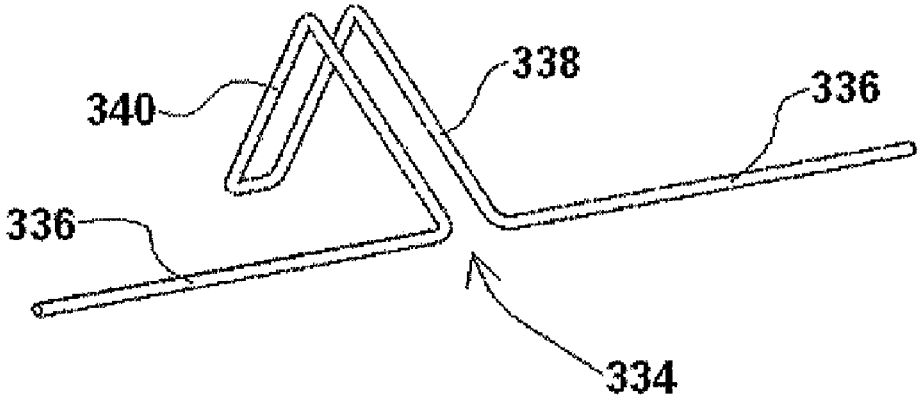
FIG. 7 is a perspective view of yet another spacer in accordance with this invention.

FIG. 7 shows yet another wire form spacer 334 bent to have a pair of horizontal ends 336 which have a horizontal transition section 338 and an intermediate downwardly bent section 340 which would be vertically oriented to fit between a pair of panels with each end 336 resting on a panel. This open hook installation utilizes a spacer that could be hanging on a batten and/or hook.

Figure 8:
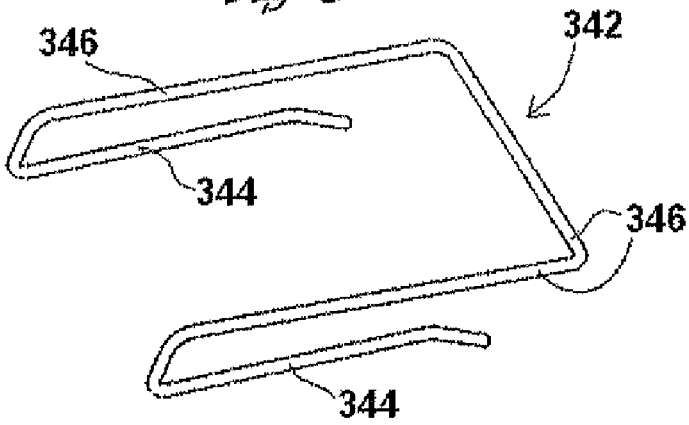
FIG. 8 is a perspective view of yet another spacer in accordance with this invention.
Figure 9:
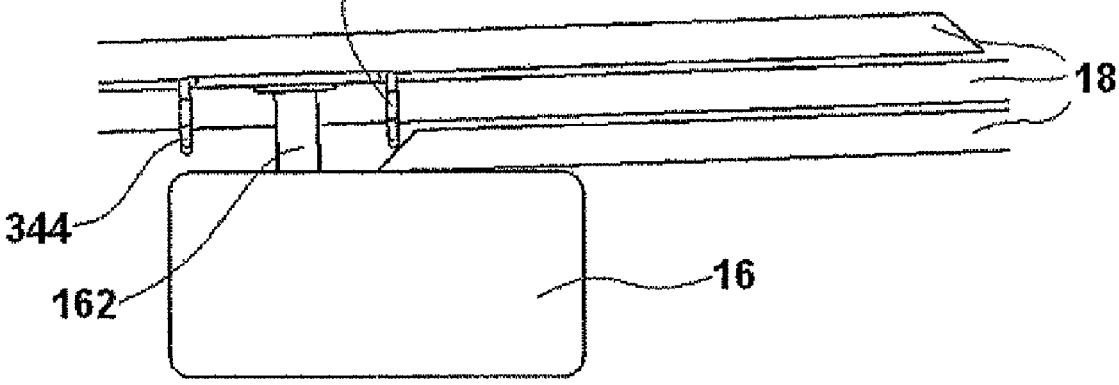
FIG. 9 is a side elevational view showing the spacer of FIG. 8 mounted in place.

Spacer 342 of FIGS. 8-9 is also a wire form spacer having a pair of bent free ends 344 which wrap around a panel 18 while the upper intermediate portion 346 is disposed on the upper surface of the panel to space that panel from its overlying panel as illustrated in FIG. 9. FIG. 9 also illustrates a fastener such as a rivet or screw 162 securing a panel to the batten 16. FIGS. 8-9 illustrate an open nailed installation where each spacer resides on or near a panel side. Such installation may but need not rest on the underlying panel's head, i.e., the resilient clip's grip resulting from the resilient ends 344 can be enough to prevent the spacer from sliding down.

Spacer 342 could also be used with a closed nail installation.

Figure 10:
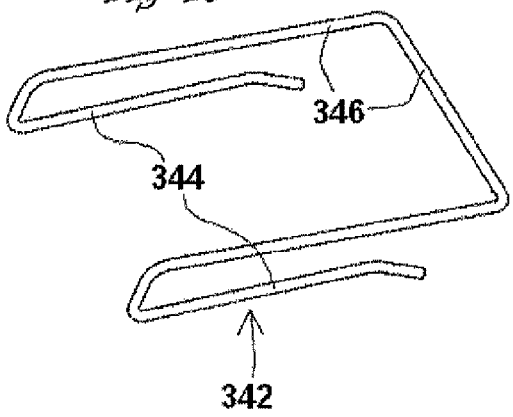
FIG. 10 is a perspective view of still yet another spacer in accordance with this invention.
Figure 11:
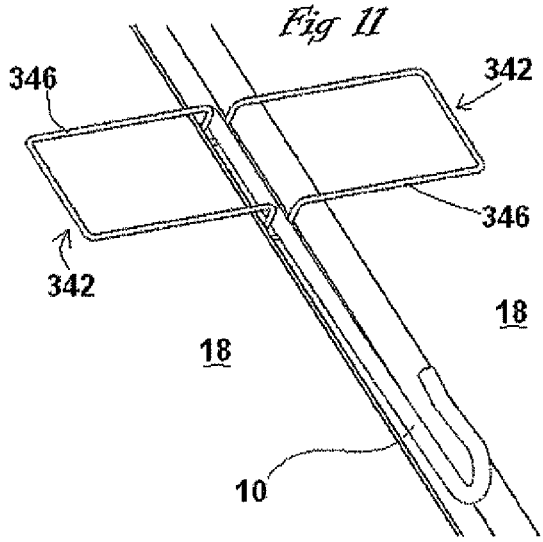
FIG. 11 is a plan view showing the spacer of FIG. 10 mounted in place.

FIGS. 10-11 show the spacer 342 used in an installation having a hook 10 where each of a pair of spacers 342 resides on or near the panel's side and may, but need not, rest on the underlying panel's head. As noted, the clip's resilient grip provided by the resilient ends 344 can be enough to prevent the spacer from sliding down.

Figure 12:
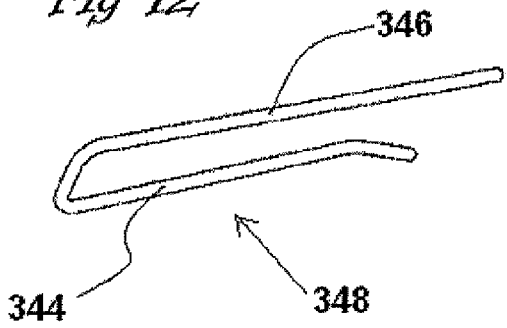
FIG. 12 is yet another spacer in accordance with this invention.

FIG. 12 illustrates yet another wire form side spacer 348 which essentially is a simplified form of spacer 342 in that it has an upper portion 346 which would lie against a panel to elevate an overlying panel. Such spacer can be used with a hook installation or with an open nail installation. The spacer can be on or near a panel's side and may, but need not, rest on the underlying panel's head, i.e., the clip's grip can be enough to prevent the spacer from sliding down.

As shown in FIG. 15, spacer 358 does not include any mounting structure to mount the spacer in place. Thus, spacer 358 is mounted in place by a portion (i.e. intermediate portions 362) being between adjacent side by side panels and at least one other portion (e.g. free ends 360) being between vertically adjacent panels, e.g. overlying and underlying panels.

The aforenoted U.S. Pat. Nos.5,794,396 and 6,052,961 show the use of S-shaped hooks where the upper end of the hook fits over an underlying panel and the lower end of the hook receives the bottom of the overlying panel. FIG. 15A is a plan view showing a roofing system which incorporates the spacer of FIG. 15 when used with hooks such as the S-shaped hooks noted above. For simplicity of viewing the relationship of such a spacer and a hook 10 FIG. 15A shows a spacer alone being mounted between panels 18A(1) and 18B(2). In addition, a hook 10 alone is shown between panel 18A(2) and panel 18A(3). Finally the combination of the spacer and hook are shown between panels 18A(3) and 18A(4). The overlying panel 18(C) is then shown received in the lower hook portion of hook 10 between underlying adjacent panels 18A(4) and 18A(5). The side view of these various stages are shown in FIGS. 15B-15D. FIG. 15B shows the spacer where the free ends 360 rest on adjacent panels [i.e. 18A(1) and 18A(2)]. The intermediate portions 362 are inclined along the side of panel 18A. The central portion 364 is located below the panel 18A. FIG. 15C shows an S-shaped hook of the type noted above wherein the upper portion of the hook 10 hooks over underlying panel 18B and the lower portion of hook 10 receives overlying panel 18C while the hook is located in the spacing between the intermediate panels 18A [i.e. panels 18A(4) and 18A(5)]. FIG. 15D is a composite of FIGS. 15B and 15C showing the relationship between a spacer and hook such as shown in FIG. 15A between panels 18A(3) and 18A (4).

Figure 13:
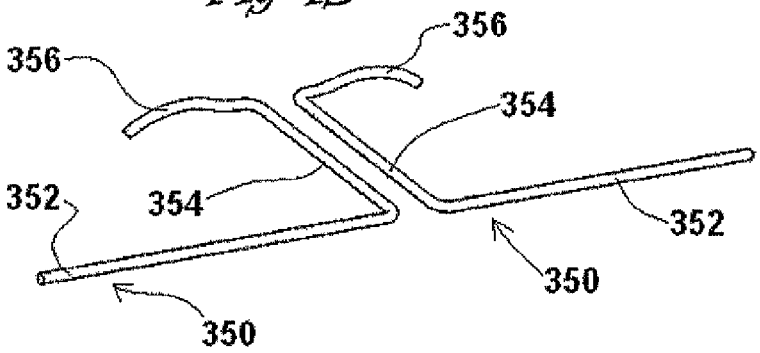
FIG. 13 is a perspective view of a set of spacers in accordance with this invention.
Figure 14:
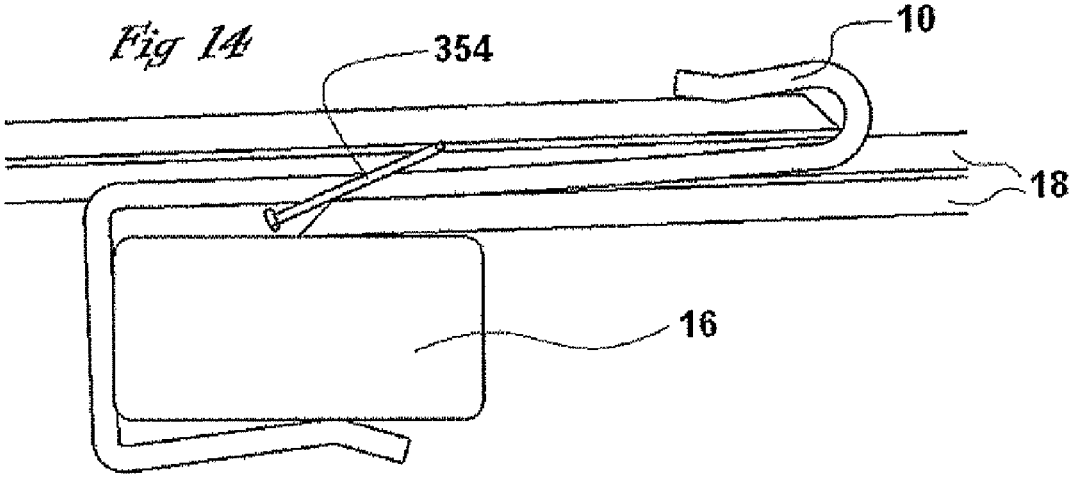
FIG. 14 is a side elevational view showing a spacer of FIG. 13 mounted in place.

FIGS. 13-14 show yet another wire form spacer 350 which has a horizontal end 352 that is bent to merge with a horizontal intermediate portion 354 which then is bent horizontally and terminates in a downward end or tip 356. As shown in FIG. 14 the intermediate portion 354 would be inclined along the side of a panel 18 while the end portion 352 would rest on the panel with the opposite end portion 356 being below the panel. In the version illustrated in FIG. 14 the hook 10 would be located between the pair of spacers 350. The spacer 350 of FIGS. 13-14 could be of a wire form that is single-sided and could be used in an open, hooked installation. Each spacer might reside on or near the panels side and may, but need not, rest on the underlying panel's head. Preferably there would be one spacer per one panel side.

The wire form spacer 358 shown in FIG. 15 is in the form having a pair of free ends 360 which are bent to form straight intermediate portions 362 and then a central undulated portion 364. The free ends 360 would rest on adjacent panels with, for example, a hook located in the open space between the free ends. The intermediate portion 362 would be inclined along the side of a panel and the central portion 364 would be located below the hook and panel. The spacer 358 may be used in an open, hooked installation and may rest on the underlying panel's head. Alternatively, the spacer 358 could be used with an open nailed installation rather than a hooked installation.

FIG. 16 illustrates a wire form spacer 366 which is formed by bending a wire so that it has a set of spaced vertical ends 368 which merge into horizontal transition portions 370 with a loop in the form of a generally rectangular intermediate portion 372. Spacer 366 can hang on the head of the underlying slate or panel with the intermediate portion 372 serving to elevate the overlying panel and the free ends 368 disposed between adjacent panels. The intermediate portion or loop 372 would span across and be against the upper surface of adjacent panels with ends 368 between those panels.

The wire form spacer 374 shown in FIG. 17 is a variation of the spacer 366 shown in FIG. 16. With spacer 374, however, the intermediate portion 376 includes a central downwardly extending U-shaped section 376 and is thereby an interrupted loop. Where used with a hook, the hook would be located in the space between the free ends 68 and in the cradle formed by downward portion 376. The spacer 374 can rest on top of a batten.

FIG. 18 illustrates a wire form spacer 378 which is asymmetrical in shape and includes a horizontal end 380 that could span adjacent panels and, for example, be located above a hook while an intermediate portion 382 is inclined downwardly between the two adjacent panels along side the hook with the opposite free end 384 being downwardly bent and located below a panel.

FIG. 19 illustrates a further wire form spacer 386 made from a single wire wherein the ends 388 generally form a rectangle and merge into a pair of spaced portions 390 which terminate in central undulated loop 392. As shown in FIG. 20 the end portions 388 are located on top of a panel 18 while the intermediate portions 390 extends downwardly along the sides of adjacent panels with the central loop 392 being below the panels. Spacer 386 could be used in an open hooked installation or in a closed nailed installation. The spacer 386 could be used by being positioned facing upslope in, for example, an open hook installation where all the wire spacer designs are "flipped-up" and thus work in the upslope direction. The spacer 386 could also be used in a closed nail installation on, for example, a closed deck.

Figure 21:
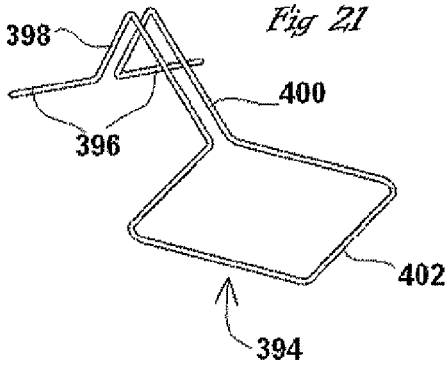

FIG. 21 illustrates a wire form spacer 394 having a pair of oppositely extending ends 396 which merge into vertical portions 398 which in turn merge into intermediate portions 400 with a loop in the form of a generally diamond-shaped central portion 402. Spacer 394 could act as a spring which functions as a cushion between panels or slates. Different versions could be used on open, closed, hooked, nailed or clipped installations. The diamond-shaped central portion 402 would rest on the upper surface of adjacent slates or panels over a hook where a hook is used with the connecting portions 398 extending vertically between the sides of the adjacent panels and the terminal ends 396 below the panels. By having the free ends 396 bent outwardly the free ends prevent pull-out. Although FIG. 21 illustrates the central portion to be diamond-shaped, other shapes could be used such as rectangular or arcuate. Spacer can be bent to hang on top of a batten.

Figure 22:
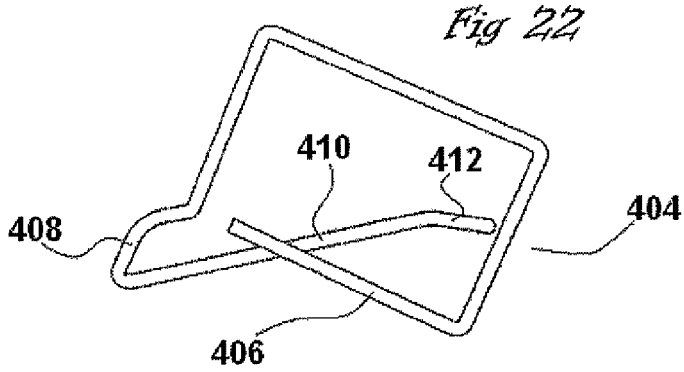

FIG. 22 shows yet another wire form side spacer 404 which has its free end 406 bent into diamond or square or rectangular or other suitable shape loop and then merges into a vertical portion 408 which merges into a straight portion 410 terminating in a bent tip 412. The portion 406 would lie on top of a slate or panel and could span adjacent panels and the vertical portion 408 would be disposed vertically along the side of a panel between adjacent panels with the end portions 410,412 underlying a single panel. In a preferred use a single spacer is mounted on a single panel rather than spanning a pair of adjacent panels.

Figure 23:
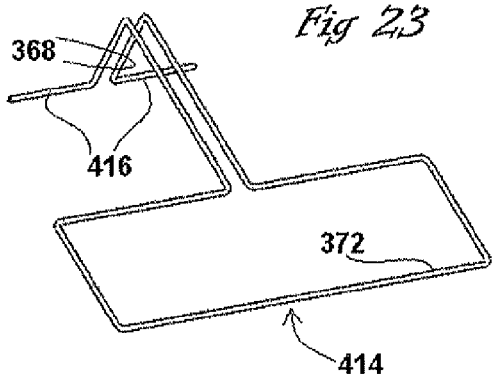

FIG. 23 illustrates a wire form spacer 414 similar to that of spacer 366 in FIG. 16. A difference is that the free ends 368 of the spacer 414 are bent outwardly to form horizontally oriented tips 416 which prevent pullout.

Figure 24:
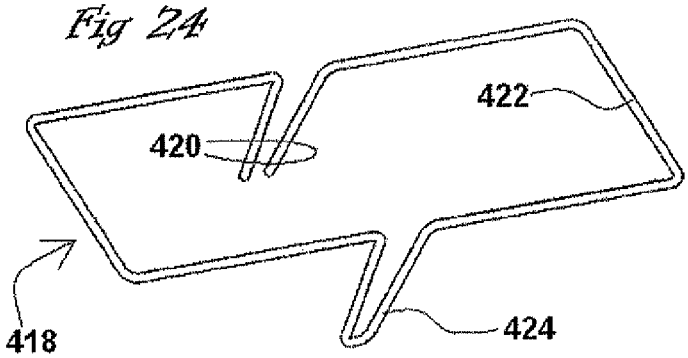

FIG. 24 illustrates a wire form spacer 418 which is formed by having the free ends 420 vertically disposed and then merging into a generally rectangular upper portion 422 with a downwardly extending central portion 424. Spacer 418 can rest on the head of the underlying panel or slate with the free ends 420 and intermediate portion 424 located in the spacing between adjacent panels.

FIG. 25 illustrates a wire form spacer 426 similar to that of FIG. 24. A difference, however, is that the free ends 428 of spacer 426 have shoulders 430. As shown in FIG. 26 the shoulders rest against the undersurface of a panel 18. Such spacer could be used in an installation having a hook 10.

Figure 27:
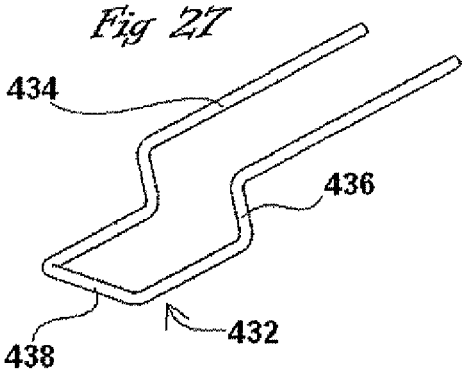

FIG. 27 illustrates a wire form spacer 432 having generally horizontal free ends 434 which merge into vertical portions 436 and then merge into U-shaped horizontal central portion 438. Free ends 434 would rest on the upper surface of a panel with the vertical portions 436 being between the sides of adjacent panels and the central portion 438 being mounted below the panel opposite to that of the panel on which free ends 438 rest.

Figure 28:
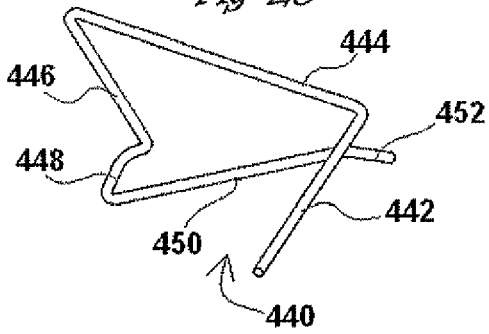

FIG. 28 illustrates a wire form side spacer 440 which has a horizontal free end 442 merging into an adjacent portion 444 thereby forming a generally horizontal V or triangle which would be disposed on top of a panel. The adjacent portion 444 merges into a further horizontal portion 446 which would also lie on top of the panel. Portion 446 then merges into a generally vertical portion 448 that would be disposed alongside of and could partially wrap around the side of the panel with the next portion 450 and bent end 452 lying below the panel.

Figure 29:
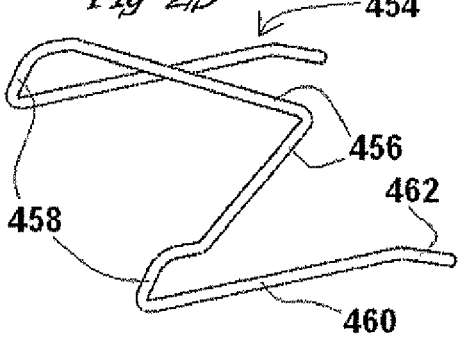

FIG. 29 illustrates a variation of wire form side spacer 454 bent to have a generally intermediate horizontal V-shape section 456 which would rest on top of a panel and which merges into vertical portions 458 that would lie along the sides of and partially wrap around a panel with the free end 460 and bent tip 462 lying beneath the panel.

Figure 30:
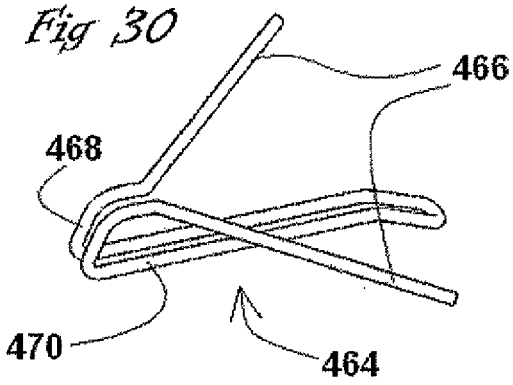

FIG. 30 illustrates yet another wire form side spacer 464 having a pair of diverging horizontal free ends 466 that would lie on top of a panel. Free ends 466 merge into vertical portions 468 which would be disposed against the side of and wrapped around the side of a panel and which then terminate in a bent central portion 470 that would lie below the panel.

An advantage of the various forms of wire form spacers is that unlike some spacers no element on the surface of the panel or slate can catch water. Rather, every element that touches the panel could be either very nearly a point (underneath) or sloped downward to promote water leaving the spacer and running off down the roof. As with other variations, the spacers could be prevented from sliding down slope by having sufficient resiliency to grip on the panel and/or by lodging a portion of the spacer in a hole or notch or by the use of underlying elements. It is noted, as with other spacers, the wire form spacers can be used on a variety of support structures.

While the foregoing description refers to various wire forms for tracks, fasteners and spacers, it is to be understood that the wire form need not be one which has a circular cross-section. Instead, the invention could be practiced where the cross-section is generally oval or even flat and where appropriate the wire form could be a narrow band.

FIGS. 31-33 illustrate another practice of this invention. As shown in FIG. 31 a spacer 490 is made of wire form to include a pair of triangles 492,494 interconnected by portion 496, generally similar to the manner in which a paper clip is formed.

FIG. 32 illustrates a variation where the spacer 500 is also formed with a pair of triangles 502,504 interconnected by straight portion 506. The triangles 502,504 are not as symmetrical as the triangles 492,494.

FIG. 33 illustrates the spacer 490 mounted to a panel 18 where each of the triangles is located on a different surface of the panel 18 with the connecting portion 496 being along the side of the panel. The spacers 490 and 500 are preferably, but need not be used on the edges of the panels, particularly along the end panels at the sides of a roof, rather than for intermediate panels. One or more spacers could be used for each panel.

Although the previous spacers are illustrated as being in the form of a single wire of circular cross-section, it is to be understood that such wire may also be of multi-filaments which are in tow or parallel form or which are twisted or braided. The wire spacer could be of circular or of generally circular or of oval cross-section. In addition, the spacer could have some flatness, such as being a thin band or strip. Accordingly, the spacers may be considered as being of wire/band form.

A further aspect of this invention is the use of a spacer in combination with a fastener, such as a rivet. In that regard, tail rivets have been used with roofing panels, such as natural and fibre-cement slates. Such tail rivets respond to temperature differences on the top and bottom surfaces, the potential to curve and the potential to lift the panel in the wind. FIGS. 34-38 illustrate known practices utilizing rivets for holding down panels, particularly slate panels which may have a non-planar or irregular surface. FIG. 34 illustrates a panel 18 having a rivet 510 mounted to the panel inwardly from its top edge. The rivet 510 includes an outwardly extending shank 512.

FIG. 35 shows the panel 18 which has the rivet 510 located below a pair of adjacent panels 18,18 with the shank 512 extending outwardly between the juxtaposed edges of the staggered overlying adjacent panels 18,18. FIG. 36 shows a further overlying panel 18 in staggered relationship above the intermediate panels 18,18 wherein the rivet is located for its shank to extend through a hole 514 in the lower portion or tail of the uppermost panel 18. As shown in FIGS. 37 and 38 the rivet from the lowermost panel 18 then has its shank 512 bent to hold the various panels in place.

Figure 39:
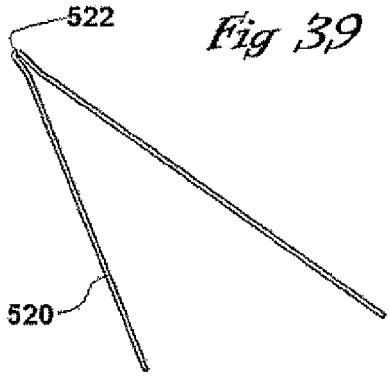
Figure 40:
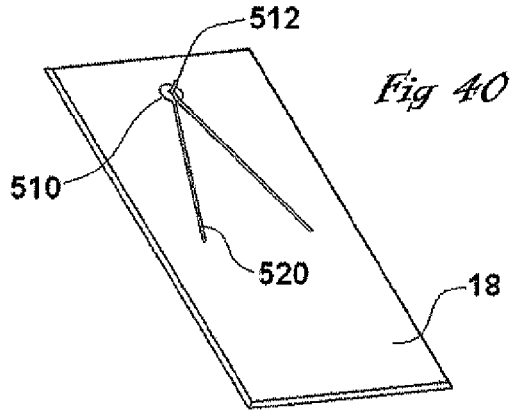
Figure 41:
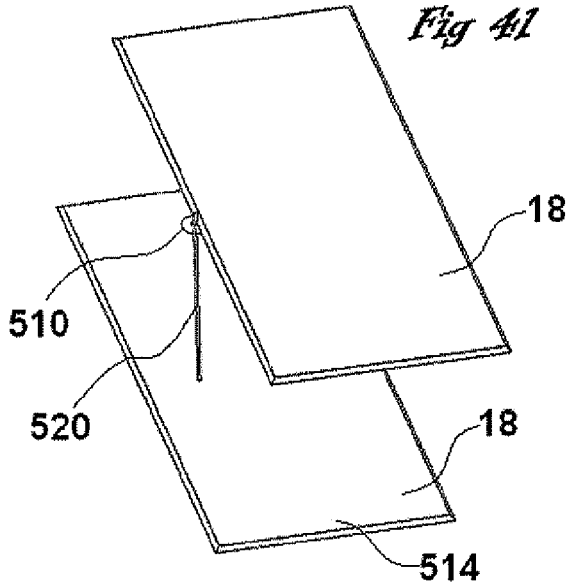
Figure 42:
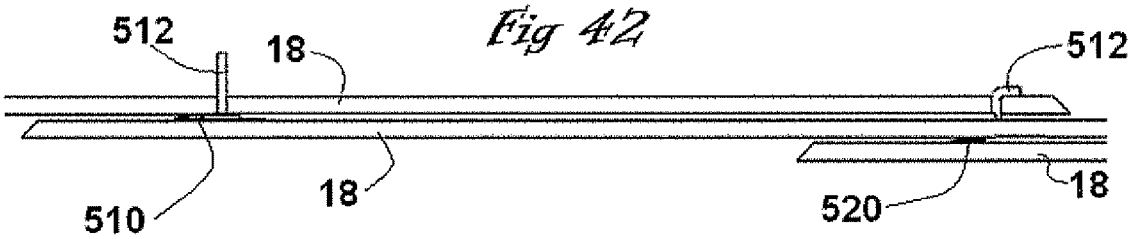

FIG. 39 illustrates a wire/band form of spacer 520 which could be used in combination with a fastener, such as a rivet 510. As shown in FIG. 40 the spacer 520 is bent to include a central partial loop 522 that would fit over the shank 512 of rivet 510. FIG. 40 thereby illustrates such mounting of a spacer 520 on a panel 18. FIG. 41 shows an overlying panel 18 similar to one of the staggered overlying panels in FIG. 35. FIG. 42 is similar to FIG. 38 except that it illustrates a practice of the invention wherein there are three rows of overlying panels 18 with the shank 512 extending through the uppermost panel and being bent over. FIG. 42 also shows a further rivet 510 where its shank 512 has not yet extended through a further overlying panel.

While FIGS. 40-42 show the mounting of a spacer to a panel through use of a rivet, the invention could be practiced with other forms of fasteners having a shank that would be bent over a panel to hold down the panel. Thus, for example, the fastener might be a nail or pin extending through a panel where the nail head or pin head is on one side of the panel and its shank extends through a hole in the panel. The spacer would be mounted to the shank before the shank is bent over an outer panel.

The concept of mounting a spacer to a fastener or rivet may be carried out in various manners. The spacer 520 is of simplified structure which is generally an inverted V. Other forms of spacers could be bent or non-linear one or more times. The spacer need not be metal or wire, but could be a strip or band or other suitable form. Such spacer could be perforate, having one or more holes, which could be utilized for receiving the shank 512 of fastener or rivet 510.

Figure 43:
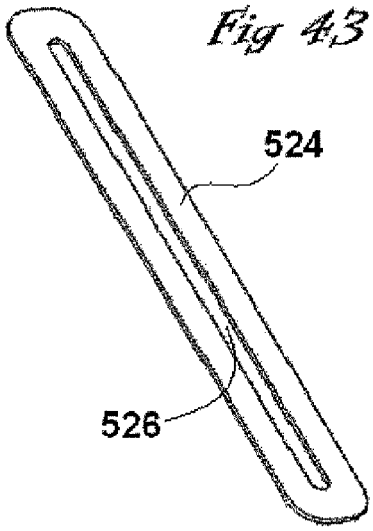
Figure 44:
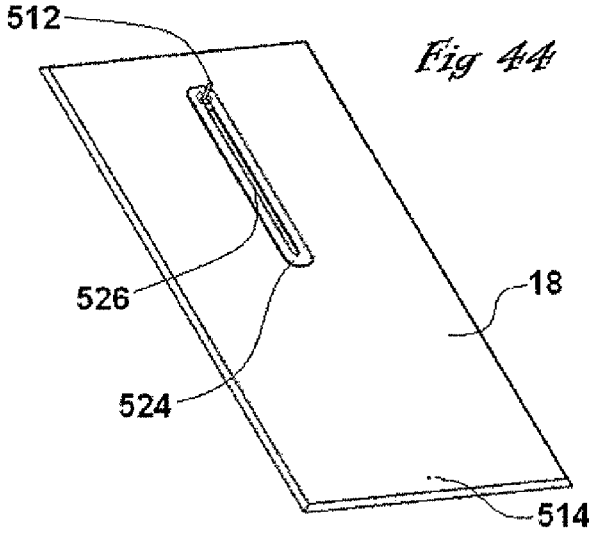

FIG. 43 illustrates an alternative spacer 524 which is in the form of a flat strip or band having a longitudinal elongated centrally located slot 526. FIG. 44 illustrates the spacer 524 mounted on a panel 18 by inserting the shank 512 of a fastener/rivet through the slot 526. The elongated slot 526 permits movement of the spacer once the shank 512 has been inserted through the slot.

Figure 45:
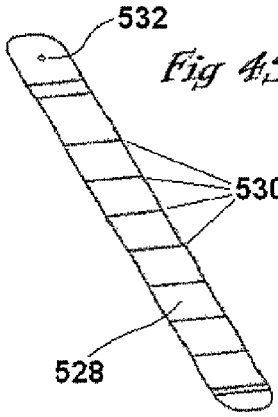

FIG. 45 illustrates a further form of spacer 528 which is provided with any suitable surface irregularities 530 such as undulations and/or prominences and/or depressions to enhance the spacing effectiveness and/or stiffness of the spacer. While FIG. 45 generally shows these irregularities 530 to be horizontal and parallel with each other and generally evenly spaced, the invention could be practiced where the irregularities do not have such a uniform relationship with each other and could be of various length and/or number and/or spacing and/or of random size and shape and location. As shown in FIG. 45 a hole 532 is provided in spacer 528 through which the shank 512 of the fastener/rivet may be inserted.

Figure 46:
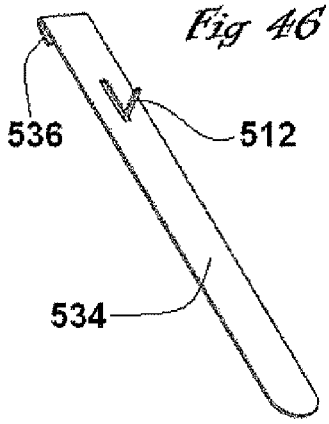

FIG. 46 illustrates a further practice of the invention wherein the generally flat band spacer 534 has a hook end 536 for fitting around the edge of a panel. FIG. 46 further shows another alternative practice of the invention wherein the fastener or rivet is integral with the spacer 534 so that its shank 512 is permanently secured to the spacer 534. Such feature of an integral fastener can be used with various types of spacers and is not necessarily used only with a spacer having a hooked end 536. Alternatively, a hook portion could be provided on the spacer at either end or at a side edge in accordance with where the spacer is intended to be mounted to a panel and/or to underlying structure such as a batten.

Figure 47:
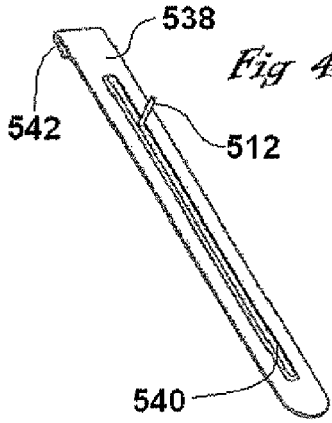

FIG. 47 shows yet another flat band-type spacer 538 having an elongated slot 540 and a hook end 542. The slot 540 is similar to slot 526 in the spacer 524 of FIG. 43. In that regard, the shank 512 would extend through the slot 540. As with the embodiment of FIG. 46 the hook end 542 could be completely omitted or could be located at other portions of the spacer. Similarly, as with FIG. 46, the fastener/rivet could be integral with the spacer or could be integral with a panel.

Figure 48:
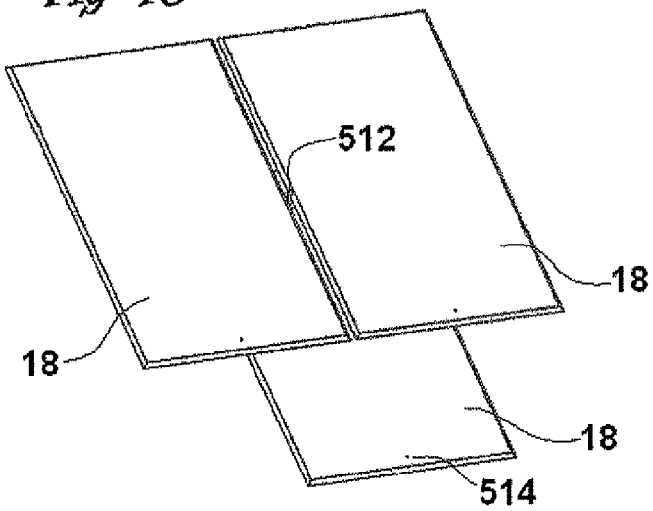

FIG. 48 shows an underlying panel 18 which would have one of the spacers shown in FIGS. 43-47 mounted to its fastener/rivet so that the shank 512 thereby extends upwardly between the adjacent overlying panels 18,18.

Figure 49:
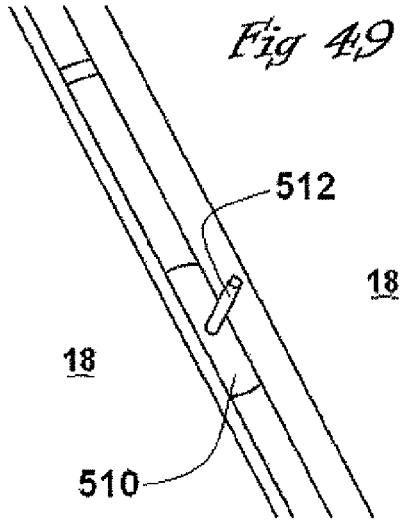
Figure 50:
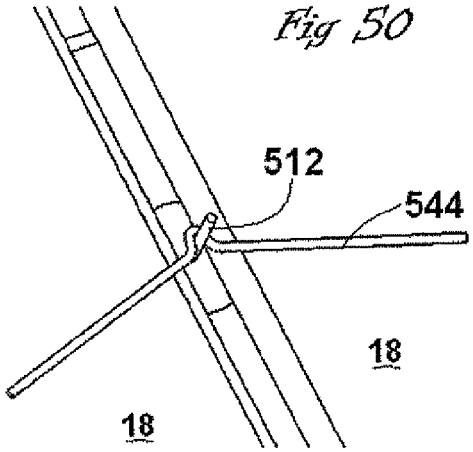

FIG. 49 shows the shank 512 of a fastener/rivet 510 located between adjacent panels 18,18. FIG. 50 shows a spacer 544 similar to the spacer 520 hooked over the shank 512 prior to the shank being inserted through the hole 514 of an uppermost panel.

Figure 51:
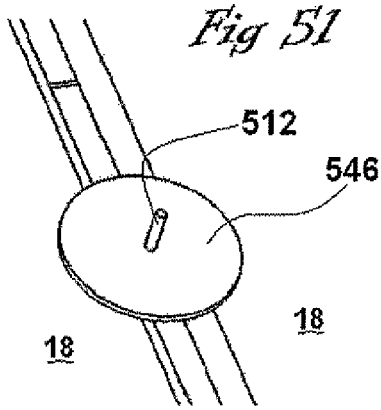

FIG. 51 shows an alternative to the arrangement of FIG. 50 wherein the spacer 546 is a disk mounted on shank 512. As illustrated, the disk 546 is a flat disk having a central hole for receiving the shank 512 of the fastener/rivet. This practice of the invention, however, may be practiced with disks of other size and shape (such as conical or rippled shapes) and/or with the hole located off-center.

The techniques using spacers with fasteners, such as rivets, as shown in FIGS. 39-51, could be practiced with different variations. The spacer-fastener/rivet structure could be horizontal or could be vertical. The upper edge of the piece could extend up-slope enough to reach over the upper edge of the underlying panel, then be bent inward toward the roof center in a small way. This would allow the piece to hang on the panel, which could facilitate installation.

As previously noted, an advantage of the various wire/band form of spacers is that, if desired, the spacers can be bent to conform to the irregular or non-planar surface of slate or of any other types of panels.

One of the advantages of the various wire/band form spacers is their incorporation in installations where the panels are mounted by the use of nails. Nails can cause the belly of the panel or slate to curve down. Maximum separation can be enforced by using one or more spacers alone or together with spacers place elsewhere. Such one or more spacers can be placed at or near the nail zone either below the panel being nailed or above the panel, below it and near its upper edge. Such spacer can perform two functions. One function would be to separate the panels at or near the vicinity of the nail. The second function would be to support and separate the lower or edge of the central regions of the panel. The spacer may or may not have a portion on both the top and bottom faces or surfaces of the panel. Connecting such portions can provide a unitary piece that can facilitate installation by having the clip-on capability. A spacer feature that underlies the upper edge or other edges of the surfaces of the panel can space the panel from the roof structure thereby enhancing air circulation around the panel or slate and freeing water that could dam at the panel's upper edge. A spacer mounted at the panel's upper edge may lift the panel off the underlying roof structure and can also separate the panel to which it is mounted from overlying panels. The spacer can lift one or more panels from the structure below it. The use of a spacer at the upper edge of the panel can thus prevent flexing of the panel at or near the point of fastening. The spacer can be of sufficient length to reach down the upper surface of a panel and provide support for the end of the overlying panel or panels. Thus, a spacer placed between overlying panels can prevent the fastening of those panels or prevent other normal loads from causing the panels to touch or nearly touch each other.

What is claimed is:

1. In a roof system having a plurality of panels mounted to a roof structure wherein the panels comprise a plurality of rows of panels, at least some of said rows of panels being arranged in an overlapping fashion of the panels of one row with respect to the panels of an adjacent row whereby the foot of a panel in an overlying row is located above the head of at least one panel in an underlying row with the lower surface of the overlying panel being above the upper surface of an underlying panel, fastening members fastening said panels to said roof structure, the improvement being in a plurality of spacers mounted between a respective said lower surface of said overlying panel and said upper surface of said underlying panel to separate at least a portion of said surfaces, each of said spacers being separate and distinct from said fastening member, said spacer being of a wire/band form structure, said spacer being mounted in place with a portion of said spacer between adjacent side by side panels and at least one other portion of said spacer between said lower surface of said overlying panel and said upper surface of said underlying panel, said spacer being otherwise free of mounting structure to mount said spacer in position, said wire/band form spacer being bent/bendable to include both horizontal and vertical portions, said spacer having a pair of free ends and an intermediate portion, said free ends being horizontal and extending outwardly and away from each other, and at least some of said intermediate portion being vertical.

2. The system of claim 1 wherein each of said free ends rests on the surface of different adjacent panels, and said intermediate portion located between said adjacent panels.

3. The system of claim 1 wherein said spacer is sufficiently rigid to be shape retaining after being bent to its intended shape.

4. The system of claim 1 wherein said panels are mounted in place by nails, said nails comprising said fastening members, and at least one of said spacers being mounted in the zone of said nails to prevent/minimize the touching of overlapping panels in said zone and to prevent panel flexing at said zone.

5. The system of claim 1 wherein said spacer is of wire form.

6. The system of claim 1 wherein said spacer is of flat band form.

7. The system of claim 2 wherein each of said free ends merges into said intermediate portion to comprise two intermediate portions, said two intermediate portions merging into an outwardly extending central portion, and said central portion being below said free ends.

8. The system of claim 1 wherein said panels are slate panels, and said spacer conforming to surface irregularities of said slate panels.

9. The system of claim 7 wherein said two intermediate portions are inclined along the sides of said adjacent panels.

10. The system of claim 9 wherein said central portion is an undulated central portion.

11. The system of claim 10 including a hook located in the open space between said free ends and hooked around an overlying panel.

12. The system of claim 11 wherein said central portion is located below said hook.

13. The system of claim 9 including a hook located in the open space between said free ends and hooked around an overlying panel.

* * * * *